United States Patent [19]

Stemmler et al.

[11] 4,332,583

[45] Jun. 1, 1982

[54] FOLDING APPARATUS FOR PREPARING A ZIGZAG WEB OF PAPER

[75] Inventors: Kurt Stemmler; Hartmut Kosche, both of Neuwied, Fed. Rep. of Germany

[73] Assignee: Winkler and Dunnebier Maschinenfabrik und Eisengiesserei GmbH & Co. KG, Neuwied, Fed. Rep. of Germany

[21] Appl. No.: 127,162

[22] Filed: Mar. 4, 1980

[30] Foreign Application Priority Data

Mar. 8, 1979 [DE] Fed. Rep. of Germany ..... 2909006

[51] Int. Cl.[3] ..... B65H 45/16

[52] U.S. Cl. ..... 493/430; 493/433

[58] Field of Search ..... 270/39, 73; 493/430, 493/433

[56] References Cited

U.S. PATENT DOCUMENTS

| | | | |
|---|---|---|---|
| 2,092,952 | 9/1937 | Campbell | 270/39 |
| 2,703,238 | 3/1955 | Hand | 493/433 |
| 4,070,014 | 1/1978 | Takahashi | 270/73 |

*Primary Examiner*—Edgar S. Burr
*Assistant Examiner*—A. Heinz
*Attorney, Agent, or Firm*—Allison C. Collard; Thomas M. Galgano

[57] ABSTRACT

A folding apparatus for preparing a zigzag web of paper or paper pulp or tissues or similar material for the production of paper handkerchiefs, paper serviettes or similar articles, has two oppositely rotating folding rolls each having a folding stick and at least one row of suction orifices for temporary retention of the web. Each roll also has two guard guides disposed before the folding stick and two guides disposed before the suction orifice row.

7 Claims, 4 Drawing Figures

Fig. 1
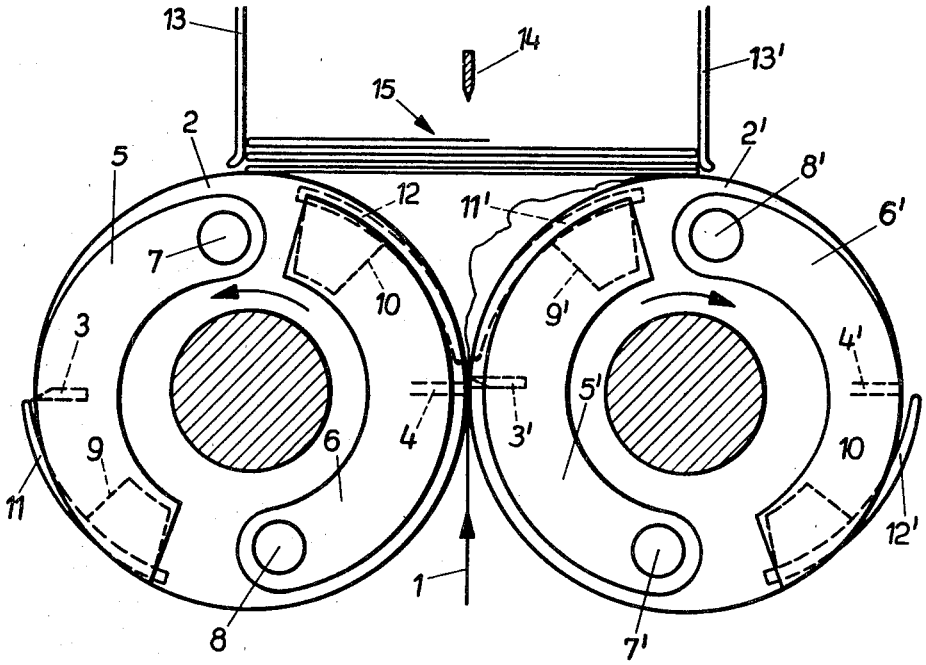
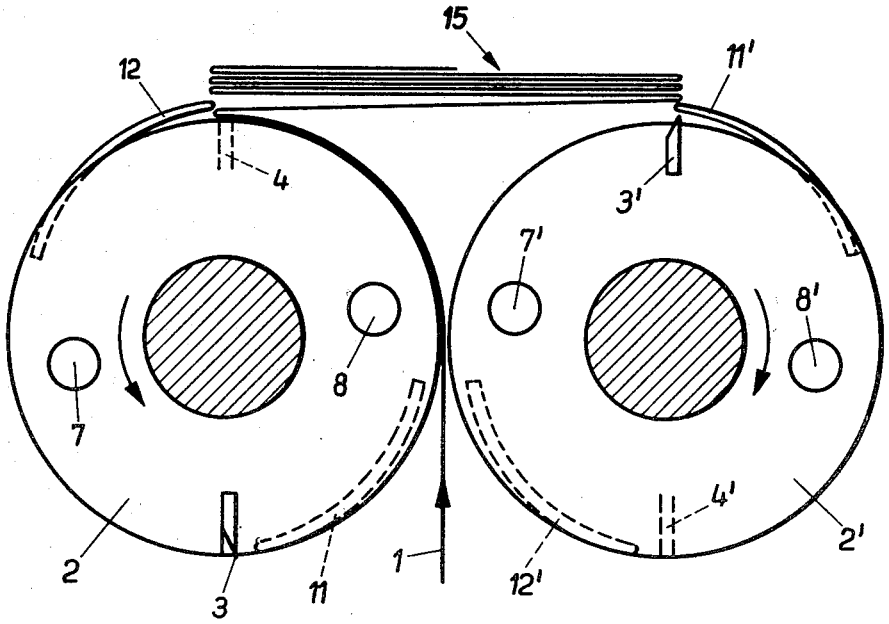
Fig. 2

Fig. 3
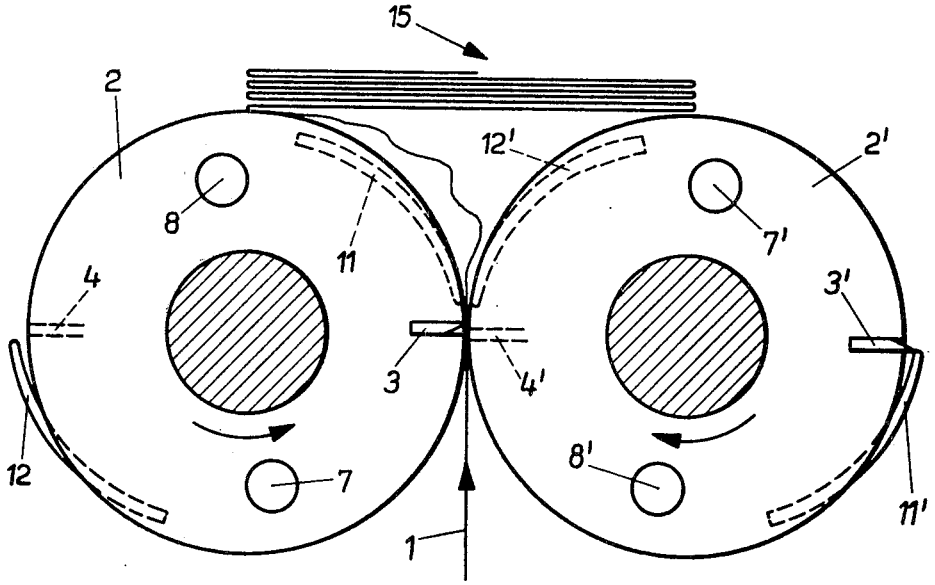
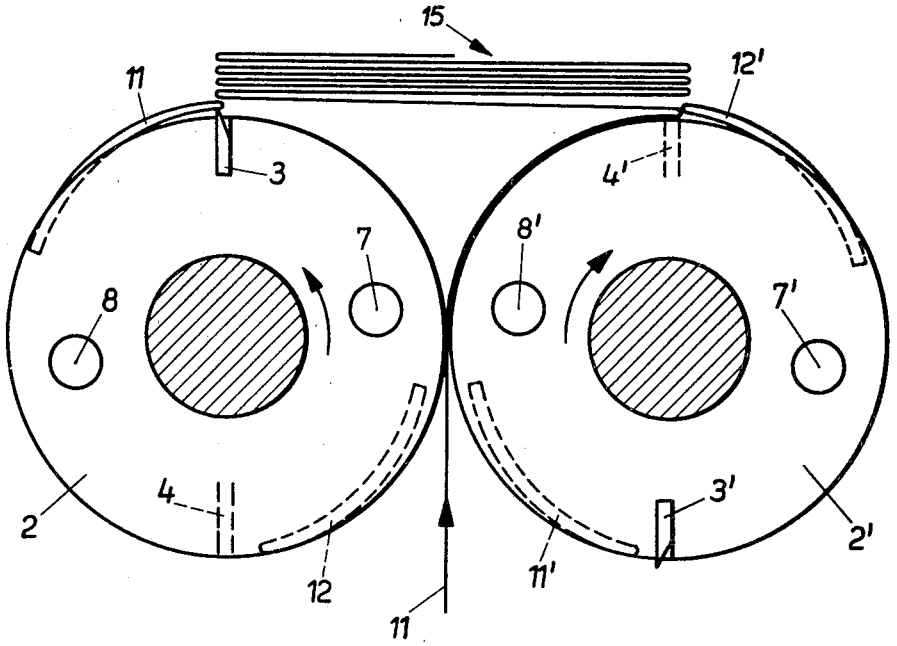
Fig. 4

FOLDING APPARATUS FOR PREPARING A ZIGZAG WEB OF PAPER

The invention relates to a folding apparatus for preparing a zigzag web of paper or paper pulp or tissue or similar material for the production of paper handkerchiefs, paper serviettes or similar articles. More particularly, it relates to such an apparatus having two oppositely rotating folding rolls each having a folding stick.

Apparatuses of this kind are known, e.g., from German Auslegeschrift No. 1 235 125 and German Offenlegungsschrift No. 2 164 081. The principle on which they operate is that a web of material folded longitudinally one or more times by means of folding plates passes between two oppositely rotating vertical folding rolls, each having a folding stick and, at a 180° offset thereto, a folding flap. As the web of material passes through between the rolls, the folding stick of one roll presses the web into the open folding flap of the other roll. The closing folding flap carries the web with it, guides it sideways and reopens when the just-formed cross-fold has reached a position predetermined by the required format of the article to be folded. The cycle of operation then repeats in the opposite direction and the result is a block which consists of a zigzag folded web. The web is then severed at its center by a cutter, the same rotating like a band saw, so that two rows of discrete articles finish-folded lengthwise and transversely result.

Folding apparatuses of the kind described are reliable and have therefore become widely employed. However, they have reached the limit of their outputs, and so there is no chance of any further increase of output from this system. Output is limited by the mass forces which occur in connection with actuation of the relatively heavy folding flaps. Another disadvantage of the known folding apparatuses is that to enable guards and delivery forks to engage, the generated or circumferential surface of the folding rolls must be formed with annular grooves making it necessary to interrupt the folding sticks at these places. This, in turn, makes folding difficult. Another disadvantage is that the noise caused by folding apparatuses of this kind is unacceptable to operating staff especially in light of the increased awareness as to environmental considerations.

It is therefore an object of the invention to provide a folding apparatus of the aforementioned type which eliminates the use of folding flaps, provides increased output and reduces noise.

This object is attained, according to the invention, by the provision of a folding apparatus wherein each folding roll is formed with at least one row of suction orifices for temporary retention of the web. In addition, each roll has two guard guides disposed before the folding stick and two guard guides disposed before the suction orifice row.

An embodiment of an apparatus in accordance with the invention will be described hereinafter with reference to the appended purely diagrammatic drawings wherein:

FIG. 1 is a cross-sectional view, in part elevation of the apparatus, showing the folding rolls at the instant of initiation of a left fold;

FIG. 2 is a view comparable to that of FIG. 1 but after the folding rolls have rotated through a further 90°;

FIG. 3 is a further view of the apparatus shown in FIG. 1, after the folding rolls have rotated a further 180°; and FIG. 4 is yet another view showing the apparatus of FIG. 1 after the folding rolls have rotated a further 270°.

Turning now in detail to the drawings, at the outset, it should be noted that in FIGS. 2 to 4, elements such as stationary guides, cutters and levers which are not essential to an understanding of the operation of the apparatus have been omitted.

In FIG. 1, the main components of the folding apparatus are illustrated which includes a left folding roll 2 and a right folding roll 2'. Rolls 2, 2' are interconnected by gearing (not shown) and rotate in opposite directions. Rolls 2, 2' are to some extent hollow and are formed with recesses in the top end faces and in their generated or circumferential surfaces. Each folding roll has an axially extending folding stick 3, 3' respectively and, disposed opposite the particular folding stick concerned (at an angle offset of about 180°), a row 4, 4' respectively of suction orifices communicating by way of control means (not shown) to a vacuum or negative pressure source (not shown).

Disposed on the top end faces of the folding rolls are levers 5, 6 and 5', 6', respectively, which are pivotable around pivots 7, 8 and 7', 8', respectively. On the side remote from the pivots, levers 5, 6 and 5', 6' are bent downwardly and their bent parts extend through recesses 9, 10 and 9', 10' respectively in the top end faces of the respective rolls 2, 2' into the partly hollow interior thereof, where arcuately-shaped guards 11, 12 and 11', 12' secured to the downwardly bent lever ends project outwardly when the levers pivot. The lever systems and the guards can be of very lightweight construction, for unlike folding flaps, they do not experience heavy mechanical stressing. Correspondingly, the mass forces occurring are relatively reduced. Disposed after the rolls 2, 2' are guides 13, 13' respectively, between which a cutter 14 rotating like a bandsaw is disposed.

A web 1 which is made of paper or paper pulp or tissue or a similar material and which has previously been folded lengthwise one or more times by way of folding plates (not shown) is fed by feed rolls (not shown) between anticlockwise rotating left roll 2 and clockwise rotating right roll 2'. In FIG. 1, folding stick 3' of right roll 2' presses the web onto the circumferential surface of left roll 2 to produce in web 1 a sharp initial scoring or the like. Also, suction orifice row 4 of left roll 2 engages web 1 immediately after the just-completed scoring or the like and entrains the web into the position shown in FIG. 2, where the negative pressure associated with orifice row 4 ceases and the just-formed fold is in its left-hand end position. While rolls 2, 2' were rotating into the position shown in FIG. 2, guards 12, 11' were moved to extend from the circumferential surface of rolls 2, 2'. Guard 12 of left roll 2 is disposed generally above the row of suction orifices 4, 4' over the just-formed fold and therefore provides a space for it with respect to the block of the already zigzag folded web 15, while guard 11' of right roll 2' is above folding stick 3' and therefore screens it during rotation in relation to the just-folded web 15.

As rolls 2, 2' continue to rotate, they reach the position shown in FIG. 3 where folding stick 3 of left roll 2 presses the web 1 on to the circumferential surface of right roll 2' and produces a sharp initial scoring or the like in web 1. Suction orifice row 4' of right roll 2' simultaneously engages the web 1 immediately after the just-completed scoring and carries web 1 into the position shown in FIG. 4. The negative pressure in row 4' then ceases and the just-formed fold is in its right-hand end position. While rolls 2, 2' were rotating into the position shown in FIG. 4, guards 12', 11 were actuated to project from the circumferential surface of the rolls. Guard 12' of right roll 2' is above the just-formed fold and therefore ensures that there is space between the same and the block of zigzag folded web 15, while guard 11 of left roll 2 is above folding stick 3 and therefore protects it during rotation from the already folded web 15.

Eccentrics (not shown) actuate guards 11, 12 of left roll 2 and guards 11', 12' of the right roll 2 so that the guides project from the circumferential surface of the respective rolls 2, 2' simultaneously as suction orifices row 4 and 4' of one roll and folding stick 3, 3' respectively of the other roll, register with one another when the associated row and folding stick move towards the just zigzag folded web 15; as the rolls continue to rotate the guides retract.

The suction is controlled by known valves (not shown), which in a predetermined position, connect orifice row 4, 4' of roll 2 or 2' respectively, to a source of negative pressure so that web 1 is retained on the respective roll and so that, once a predetermined position has been reached, the suction orifice row is disconnected from the negative pressure source and placed in communication with the atmosphere to disengage web 1 from roll 2 or 2'.

While only one embodiment of the present invention has been shown and described, it will be obvious to those persons of ordinary skill in the art that many changes and modifications may be made thereunto, without departing from the spirit and scope of the invention.

What is claimed is:

1. In a folding apparatus for preparing a zigzag-folded web of paper of the type having two oppositely-rotating folding rolls, each having at least one axially-extending and radially-projecting folding stick for producing zigzag folds in the web of paper, the improvement comprising:

guide means disposed adjacent to, but spaced from, said pair of folding rolls for receiving said zigzag-folded web or paper from said folding rolls in the form of a progressively-growing stack, the base of which lies closely adjacent to said folding rolls in a plane disposed generally tangentially to the circumference of said folding rolls; and each folding roll having a circumferential surface in which is formed at least one row of suction orifices for effecting temporary retention of the web thereagainst immediately following scoring by a folding stick of the other roll, each folding roll also having at least one pair of guard guides, one of said pair for said folding stick and the other of said pair for said row of suction orifices, each guard guide having two ends and being pivotably mounted on said associated folding roll for movement between a retracted and extended position relative to the circumferential surface thereof, said one of said guard guides associated with said folding stick, in the extended position thereof, having one end spaced radially-outwardly beyond the folding stick so as to shield and hold the base of said stack of said zigzag-folded web away from the folding stick, and said other of said guard guides associated with said row of suction orifices, in the extended position thereof, having one end spaced generally above the row of suction orifices, so as to ensure that there is a space between the same and said base of said stack of said zigzag-folded web received in said guide means.

2. The apparatus according to claim 3, wherein said guard guides are arcuately shaped.

3. The apparatus according to claim 1, additionally including means for pivotably mounting said guard guides on said folding rolls.

4. The apparatus according to claim 3, wherein each folding roll has an end face and wherein said means for pivotably mounting comprises a lever having one end pivotably mounted on said end face and an opposite end to which the other end of a guard guide is secured.

5. The apparatus according to claim 1, additionally including cutting means associated with said guide means for severing said folded web.

6. The apparatus according to claim 1, wherein said row of suction orifices and said folding stick are displaced at an angle offset of about 180° relative to one another on said circumferential surface of each of said folding rolls.

7. The apparatus according to claim 1, additionally including means for pivotably mounting said guard guides on said associated folding rolls, said means including a lever for each of said guard guides having one end pivotably secured to said associated folding roll and an opposite end secured to the other end of said associated guard guide, said one end and said other end of said levers being located on opposite sides of the respective folding stick or row of suction orifices, with which said guard guide secured thereto is associated.

* * * * *